US010512926B2

(12) United States Patent
Goettke

(10) Patent No.: US 10,512,926 B2
(45) Date of Patent: Dec. 24, 2019

(54) FINGER SPRAY PUMP AND NOZZLE HEAD FOR SPRAY PUMP

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 16/322,595

(22) PCT Filed: Jul. 31, 2017

(86) PCT No.: PCT/EP2017/069285
§ 371 (c)(1),
(2) Date: Feb. 1, 2019

(87) PCT Pub. No.: WO2018/024657
PCT Pub. Date: Feb. 8, 2018

(65) Prior Publication Data

US 2019/0151877 A1 May 23, 2019

(30) Foreign Application Priority Data

Aug. 4, 2016 (DE) ..... 10 2016 114 456

(51) Int. Cl.
*B05B 11/00* (2006.01)
*B05B 1/34* (2006.01)

(52) U.S. Cl.
CPC ..... *B05B 11/3025* (2013.01); *B05B 1/3436* (2013.01); *B05B 11/3047* (2013.01)

(58) Field of Classification Search
CPC ..... B05B 11/3025; B05B 1/3436; B05B 11/3047; B05B 11/3074
(Continued)

(56) References Cited

U.S. PATENT DOCUMENTS 4,029,261 A * 6/1977 Olegnowicz ..... B05B 11/3023 239/333
4,074,861 A * 2/1978 Magers ..... B05B 1/3436 239/492
(Continued)

FOREIGN PATENT DOCUMENTS

DE 502 17 585 T2 10/2007
DE 20 2014 103 981 U1 11/2015
(Continued)

OTHER PUBLICATIONS

International Search Report of PCT/EP2017/069285, dated Feb. 27, 2018.

*Primary Examiner* — Patrick M. Buechner
*Assistant Examiner* — Michael J. Melaragno
(74) *Attorney, Agent, or Firm* — Collard & Roe, P.C.

(57) ABSTRACT

A finger spray pump for spraying a medium has a finger-actuated pump head movable between a spraying position and an initial position. The pump has an outlet nozzle and a pump chamber with an inlet valve and an outlet valve, a piston rod, a pump piston, a first spring acting between the piston rod and the pump piston, and a second spring acting between the piston rod and the pump housing. The pump piston is movable between a sealed position and an open position, to form the outlet valve, wherein the pump piston in the sealed position lies on a sealing extension of the piston rod and in the open position allows the passage of medium between the sealing extension and the pump piston. The pump piston is supported on two zones of an outer surface of the piston rod that are axially spaced apart.

10 Claims, 9 Drawing Sheets

(58) Field of Classification Search
USPC ..... 222/321.7, 321.8, 321.9
See application file for complete search history.

(56) References Cited

U.S. PATENT DOCUMENTS 4,140,249 A * 2/1979 Majima ..... B05B 11/3019 222/321.2
5,234,135 A 8/1993 Lafosse et al.
5,358,179 A * 10/1994 Lund ..... B05B 1/26 239/333
5,388,766 A * 2/1995 Buisson ..... B05B 1/3436 222/321.2
5,439,177 A 8/1995 Graf et al.
5,697,530 A * 12/1997 Montaner ..... B05B 11/3063 222/321.2
5,711,488 A * 1/1998 Lund ..... B05B 1/3436 239/333
5,803,318 A * 9/1998 Lina ..... B05B 11/3025 222/321.2
5,931,386 A * 8/1999 Jouillat ..... B65D 83/20 239/463
6,234,412 B1 * 5/2001 von Schuckmann ..... B05B 1/3436 239/333
6,533,196 B1 * 3/2003 Ouin ..... B05B 1/3436 239/476
6,595,395 B2 * 7/2003 Jourdin ..... B05B 11/3049 222/321.9
6,772,913 B2 * 8/2004 Garcia ..... B05B 11/3049 222/153.09
6,776,312 B2 * 8/2004 Masuzzo ..... B05B 11/007 222/321.7
6,824,077 B2 11/2004 De Laforcade
7,281,644 B2 * 10/2007 Cater ..... B05B 11/3025 222/321.2
7,300,001 B2 * 11/2007 Kuo ..... A61M 11/00 239/333
7,497,356 B2 3/2009 Beranger et al.
7,886,995 B2 * 2/2011 Togashi ..... B05B 1/341 222/321.8
7,938,342 B2 * 5/2011 Octeau ..... B05B 1/3436 239/333
7,954,677 B2 6/2011 Langlois et al.
8,016,164 B2 * 9/2011 Pares Montaner ..... B05B 11/3007 222/321.2
8,056,770 B2 11/2011 Lompech et al.
8,074,845 B2 * 12/2011 Garcia ..... B05B 11/3046 215/274
8,276,835 B2 * 10/2012 Lowry ..... B65D 83/206 239/468
8,672,190 B1 * 3/2014 Wang ..... B05B 11/0008 222/153.13
8,690,081 B2 * 4/2014 Cornet ..... B05B 1/3436 222/402.1
8,844,843 B2 * 9/2014 Horiuchi ..... B05B 1/3436 239/468
9,364,838 B2 6/2016 Parmentier
9,999,895 B2 * 6/2018 Nelson ..... B05B 1/3426
10,130,960 B2 * 11/2018 Gopalan ..... B05B 1/3436
10,155,237 B2 * 12/2018 Huang ..... B05B 11/3025
2003/0150880 A1 * 8/2003 Marelli ..... B05B 11/3025 222/321.7
2004/0099694 A1 * 5/2004 Suzuki ..... B05B 11/3002 222/321.9
2006/0037973 A1 * 2/2006 Garcia ..... B05B 11/3025 222/321.9
2008/0067262 A1 3/2008 Varanasi et al.
2008/0164344 A1 * 7/2008 Lompech ..... B05B 11/3008 239/333
2009/0057447 A1 * 3/2009 Lowry ..... B05B 1/3436 239/601
2010/0224653 A1 * 9/2010 Donnette ..... B05B 11/3025 222/321.9
2011/0114674 A1 * 5/2011 Nicolle ..... B05B 11/3004 222/321.9
2012/0006854 A1 * 1/2012 Carta ..... B05B 11/3023 222/321.7
2012/0305604 A1 * 12/2012 Wang ..... B05B 11/3023 222/321.9
2012/0325862 A1 * 12/2012 Kuwahara ..... B05B 11/3023 222/321.9
2013/0306757 A1 * 11/2013 Parmentier ..... B05B 1/3436 239/404
2014/0217124 A1 * 8/2014 Kim ..... B05B 1/3415 222/321.9
2016/0068331 A1 * 3/2016 Clark ..... B05B 1/14 222/402.1
2016/0152405 A1 * 6/2016 Ghavami-Nasr ..... B05B 7/0483 222/402.1
2017/0266679 A1 9/2017 Goettke
2018/0017051 A1 * 1/2018 Beranger ..... F04B 9/14
2018/0093286 A1 * 4/2018 Jourdin ..... B05B 11/3001
2018/0169680 A1 * 6/2018 Goettke ..... B05B 11/0029
2018/0178233 A1 * 6/2018 Goettke ..... B05B 11/0029

FOREIGN PATENT DOCUMENTS

EP 0 486 378 A1 5/1992
EP 0 711 571 A1 5/1996
EP 1 949 973 A1 7/2008
EP 1 935 503 B1 5/2012
FR 2 849 000 A1 6/2004
FR 2 857 340 A1 1/2005
WO 91/13688 A1 9/1991
WO 2012/110744 A1 8/2012

* cited by examiner

FINGER SPRAY PUMP AND NOZZLE HEAD FOR SPRAY PUMP

CROSS REFERENCE TO RELATED APPLICATIONS

This application is the National Stage of PCT/EP2017/069285 filed on Jul. 31, 2017, which claims priority under 35 U.S.C. § 119 of German Application No. 10 2016 114 456.8 filed on Aug. 4, 2016, the disclosures of which are incorporated by reference. The international application under PCT article 21(2) was not published in English.

FIELD OF TECHNOLOGY

The invention initially relates to a finger spray pump for spraying a medium, comprising a finger-actuated pump head movable relative to a pump housing between a spraying position and in initial position, wherein the pump housing has a guide portion, further comprising an outlet nozzle and a pump chamber, wherein the pump chamber has an inlet valve and an outlet valve, a piston rod, a pump piston, a first spring acting between the piston rod and the pump piston, and a second spring acting between the piston rod and the pump housing, wherein the pump piston is further movable relative to the piston rod to a limited extent between a sealed position and an open position, to form the outlet valve, wherein the pump piston in the sealed position lies on a sealing extension of the piston rod and in the open position allows a medium passage between the sealing extension and the pump piston, wherein further the pump piston is supported in the sealed position as well as in the open position on two areas of an outer surface of the piston rod, which are axially spaced apart, wherein the piston rod consists of a central piston rod portion and an outer piston rod cylinder portion and wherein, on its piston-side end, the piston rod cylinder portion has a taper, which further on the end side transitions again into a support shoulder, which further extends radially in relation to the taper.

The invention further relates to a nozzle head for a spray pump, preferably finger-actuated spray pump, comprising a pump head, a receiving pin in the pump head, and a cap having a spray nozzle being catch-mounted in the pump head in association with the receiving pin, wherein the receiving pin has a longitudinal axis extending in the mounting direction of the cap, and a liquid path in the direction of the longitudinal axis is embodied in the receiving pin, which liquid path leads to a central chamber positioned upstream of the spray nozzle, wherein the central chamber further has inlet channels, which extend in a plane running perpendicular to the longitudinal axis and which are partly formed by an inner surface of the cap and partly by an outer surface of the receiving pin, wherein further the boundary surfaces of the inlet channels, with the exception of a bottom surface, are only embodied in the cap and wherein the receiving pin has a closed planar front face, which is simultaneously used to form the boundary surfaces of the inlet channels, characterized in that the front face is surrounded by a circumferential surface, which runs in a stepped manner with regard to said front face and which extends at least across the circumferential angle, in which the inlet channels are spaced apart, that the inlet channels radially outwards lead into an annular channel, which is created as a result of the circumferential surface, that a side wall of an inlet channel is built by a rib formed in the cap and that the running through rib in circumferential direction and seen with reference to a longitudinal axis builds the inner side wall as well as the outer side wall of each inlet channel and moreover a radial outer connection wall between the outer side wall and the inner side wall of each inlet channel.

PRIOR ART

Finger spray pumps of the type in question are known. Reference is made, for example, to EP 1 935 503 B1 (U.S. Pat. No. 8,056,770 B2). Such finger spray pumps serve, for example, for spraying a liquid medium. The outlet valve preferably opens only upon reaching a predetermined pressure inside the pump chamber as a result of corresponding pressure admission by a finger on the pump head, whereupon the medium can escape via the medium path and the outlet nozzle. The pump head can further be moved thereby, in particular lowered, by overcoming the force of one of the springs, to expel the medium located in the pump chamber by means of pressing.

Nozzle heads of the type in question are known. Reference is made, for example, to WO 2012/110744 A1. Such nozzle heads serve for the spray-dispensing of the medium by actuating the spray pump, wherein a swirling of the medium prior to the dispensing is attained in the nozzle head in the area of the central chamber.

At a finger spray pump known from EP 486378 A1, the piston rod cylinder portion is at it end with view of a movement of the pump piston build continuously cylindrically.

SUMMARY OF THE INVENTION

Starting from the last mentioned state of the art, the invention is concerned with the object to build a finger spray pump with reference to the support of the pump piston favorably.

This object is solved by a finger spray pump, wherein the piston rod consists of a central piston rod portion and an outer piston rod cylinder portion and that, on its piston-side end, the piston rod cylinder portion has a taper, which further on the end side transitions again into a support shoulder, which further extends radially in relation to the taper.

According to the proposed embodiment, the pump piston is securely guided on the outer surface of the piston rod in both the sealed position and in the open position, preferably in the case of a compact design of the pump, which is also at hand. The support on (at least) two areas, which are axially spaced apart, counteracts a possible tilting of the pump piston from a strict alignment of the piston axis relative to a piston rod central axis. In fact, a coaxial alignment of piston rod and pump piston is at hand by means of the axially spaced apart support preferably in every possible operating position of the pump piston. The secure dispensing of reproducible amounts of the medium to be sprayed out is at hand due to the tilt-proof arrangement of the pump piston.

The support shoulder may have an outer diameter which does correspond to the one of the pump piston cylinder part in an area encompassed by the springs.

Concerning the nozzle head is in view of the state of the art further to refer to DE 60217585 T2. At the subject matter known from this the receiving pin is concerning its circumference area completely cylindrical. Moreover is from EP 711571 A1 a nozzle head with a receiving pin known which has a stepped circumference surface. In the cap are branch channels provided for which run until radially outwards to the there limiting cap wall.

Starting from the DE 60217585 T2 the invention is concerned with the object to provide the nozzle head especially in view of the branch channels favorable. This object is solved by a nozzle head, wherein the front face is surrounded by a circumferential surface, which runs in a stepped manner with regard to said front face and which extends at least across the circumferential angle, in which the inlet channels are spaced apart and that the inlet channels radial outward enter into a ring channel which is given in a correlation position of the cap which is given due to the circumference surface.

As a result of the proposed embodiment, the inlet channels and possibly also the central chamber can be provided essentially by the cap with regard to length and/or cross sectional dimensions. The embodiment of the cap accordingly contributes significantly to the design, alignment and size (cross sectional surface) of the inlet channels, wherein these inlet channels are ultimately only formed in assigned position of the cap on the receiving pin.

According to this embodiment, different caps comprising different inlet channels can be assigned to a nozzle head, for example adapted to the medium to be dispensed and/or adapted to the desired spray result. With regard to the inlet channels, the caps can differ, for example with regard to the number of the inlet channels, the cross sectional surface thereof at right angles to the longitudinal extension of the inlet channels or the alignment thereof relative to the central chamber to be formed.

To reach different spray results and/or to discharge different, sprayable media, the arrangement of an adapted cap is thus sufficient.

The support areas can also be separated at least in the sealed position in the vertical direction by means of a horizontally circumferential free space. This free space, which can form, for example, in the manner of an annular channel and running at least approximately coaxially to the pump piston axis, preferably results between the outer surface of the piston rod and the inner surface of the pump piston facing the piston rod, wherein the free space can further be at hand solely as a result of a corresponding recess between the support areas in the area of the inner surface of the pump piston or solely due to such a recess in the area of the outer surface of the piston rod. The free space can furthermore also be at hand as a result of corresponding set-back areas in relation to the assigned outer or inner surface both on the piston rod and on the pump piston.

The first spring and the second spring can be supported on the piston rod on a radially projecting shoulder. The shoulder can thereby extend in a plane aligned at right angles to the piston rod axis. The shoulder can further be fixedly connected to the piston rod or can also be made in one piece with the latter, for example in the plastic injection molding process.

In preferred embodiment, the shoulder for guiding the piston rod cooperates with a cylindrical inner surface of the guide portion on the pump housing side, wherein the springs are furthermore radially exposed in their support areas on the piston rod with regard to the guide portion. The springs are exposed, viewed from the radially inner wall of the guide portion in the direction of a central body axis of the guide portion, which preferably coincides with the piston rod axis. A radially outer coverage of the springs is at hand solely by means of the guide portion or by means of the assigned wall of the guide portion, respectively.

A radially outer front face of the shoulder can also lie on the inner surface of the guide portion in the initial position and in the spray position, furthermore preferably in every intermediate position between initial and spray position. For this purpose, the shoulder preferably forms a surface, which is formed circular cylindrically, with its radially outer front face, comprising a height, viewed in the axial direction, which can correspond to one-fifth to one-third, for example one-fourth, of the radial dimension of the shoulder. The piston rod is thus also guided in a tilt-free manner in the guide portion through this.

In one embodiment, the piston rod can consist of a central piston rod portion and an outer piston rod cylinder portion. Piston rod portion and piston rod cylinder portion are preferably fixedly connected to one another at least with regard to the axial alignment, so that no relative displacement in the axial direction to one another can occur.

Piston rod portion and piston rod cylinder portion can, as is also preferred, have essentially circular cylindrical cross sections—viewed at right angles to the piston rod axis.

On its piston-side end, the piston rod cylinder portion can have a taper, which further on the end side transitions again into a support shoulder, which further extends radially in relation to the taper. As is also preferred, the horizontally circumferential free space between the support areas of the pump piston, which are axially spaced apart, can result by means of the taper. A support of the pump piston, in particular of a pump piston shaft, axially above and below the taper can thus result.

The taper can also be assigned to a radially inner shoulder of the pump piston, which shoulder, in the spray position, comes to lie on an edge of the taper on the spray head-side. A limitation of the relative displaceability of the pump piston to the piston rod can be attained thereby.

In further embodiment, the shoulder of the pump piston can come to lie on the edge of the taper facing the inlet valve side in the initial position.

The sealing extension for cooperating with the pump piston can be embodied on the central piston rod portion. With regard to this, a one-piece embodiment, possibly also of the same material, of piston rod portion and sealing extension can be provided.

In further embodiment, the central piston rod portion can be catch-mounted in the piston rod cylinder portion. This catch connection can preferably not be operatively released. A tight connection between piston rod portion and piston rod cylinder portion at least in the axial direction preferably results from the catch connection. A rotationally fixed connection with regard to the piston rod longitudinal axis between the portions can furthermore also be attained by means of the catch securing.

In preferred embodiment, a medium path between an outer surface of the central piston rod portion and an inner surface of the piston rod cylinder portion results by means of the preferred configuration of the piston rod of a central piston rod portion and an outer piston rod cylinder portion. The medium path can be formed in a circular ring section-shaped manner in a cross section at right angles to the longitudinal extension of the piston rod, at least in the area, in which the cylinder portion surrounds the rod portion.

With its circumferential piston wall, the pump piston can support itself on the inner wall of the guide portion at least on two areas, which are spaced apart in the axial direction. The pump piston is thereby also prevented from tilting around the longitudinal axis of the piston rod.

With regard to the known prior art, a technical problem of the invention is seen in further improving a nozzle head of the type in question in an advantageous manner.

The receiving pin can, as is also preferred, have a closed planar front face, which can simultaneously be used to form the boundary surfaces of the inlet channels. In preferred embodiment, the front face forms the bottom surface of every inlet channel when the cap is secured.

The front face can be surrounded by a circumferential surface, which runs in a stepped manner in relation to said front face and which extends at least across the circumferential angle, in which the inlet channels are spaced apart. The circumferential surface, which runs in a stepped manner, can form a supply channel, which is circumferential at least across a partial circumference, for the inlet channels, which supply channel communicates with the liquid path formed in the direction of the longitudinal axis in the area of the receiving pin.

In preferred embodiment, the supply channel, which runs in the circumferential direction, is only formed with arrangement of the cap on the receiving pin. With regard to a cross section at right angles to a direction of extension of the circumferential supply channel, a bottom and a side surface can be formed by the receiving pin, and the further side surface as well as the top surface by the cap.

Concerning the central chamber, the inlet channels have flow central axes. They can run tangentially to a circle, the center of which is formed through the longitudinal axis of the receiving pin. This circle can have a maximum diameter, which can correspond to the diameter of the preferably circular central chamber. In further embodiment, the circle, into which the flow central axes of the inlet channels run tangentially, is selected to be smaller than a circle given by the circumferential wall of the central chamber. In a cross section at right angles to the longitudinal axis, the alignment of the inlet channels can thus further be selected such that a side wall running in the longitudinal extension of the inlet channel transitions tangentially into the chamber wall when the inlet channel runs freely into the central chamber.

The radius of the circle can be smaller than a greatest dimension of the central chamber at right angles to the longitudinal axis. The diameter of the circle is equal to or smaller than a circle, which, in the layout, is placed into the central chamber, which circle then at best touches the wall of the central chamber.

A side wall of an inlet channel can be embodied by a rib molded in the cap. Such a rib protrudes beyond a top surface formed by the cap for an inlet channel in the axial direction and supports itself on the front face of the receiving pin forming on the bottom surface for the inlet channel in the assigned position. A seal for the forced guidance of the medium to be dispensed via the at least partially circumferential supply channel by means of the inlet channels and the central chamber is provided in that the rib forming the side wall of an inlet channel preferably lies flat on the front face of the receiving pin.

The side walls of all inlet channels can be formed by means of only one rib, which is designed to be continuous with regard to a cross section through the cap at right angles to the longitudinal axis.

BRIEF DESCRIPTION OF THE DRAWINGS

The invention is described in more detail below by means of the enclosed drawing, which only represents an exemplary embodiment, in which.

DESCRIPTION OF THE EMBODIMENTS

Figure 1:
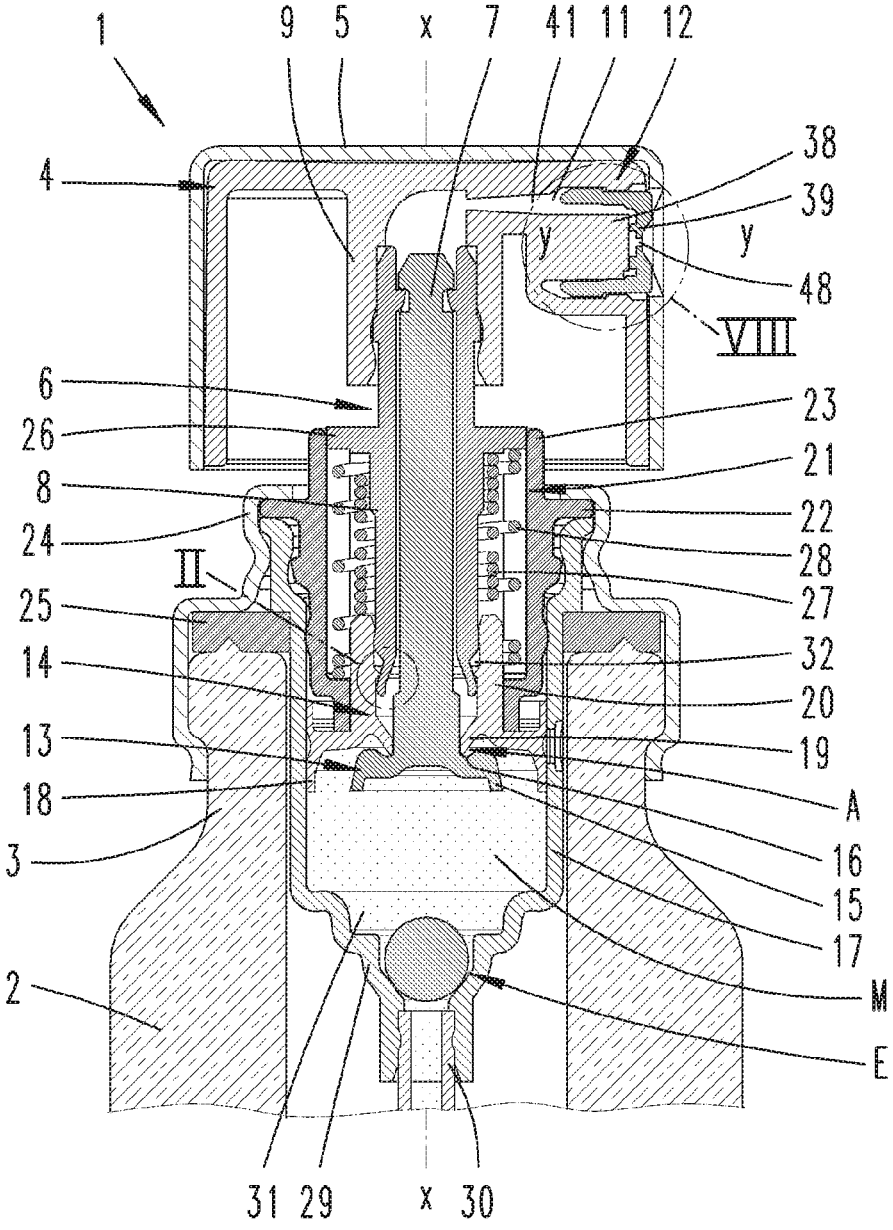
FIG. 1 shows a finger spray pump in crimp connection with a receptacle, relating to the non-actuated position of the finger spray pump, in a longitudinal sectional view.

With reference to FIG. 1, what is initially illustrated and described is a finger spray pump 1 for spraying a medium M, in particular a liquid medium.

The finger spray pump 1 is embodied for arrangement on a receptacle 2 storing the medium M, comprising a receptacle neck 3, to which the finger spray pump 1 is essentially secured. The finger spray pump 1 has a finger-actuated pump head 4, comprising an actuating surface 5, which, in the illustrated exemplary embodiment, extends essentially at right angles to a central body axis x of the finger spray pump 1 and, in the assigned state, at right angles to the body axis of the receptacle 2.

The pump head 4 as a whole is further designed approximately pot-like, comprising a pot opening pointing downwards.

On the underside of the actuating surface 5, a piston rod 6 is provided centrally and rotationally symmetrically to the boxy axis x, which piston rod extends across the plane of the pot opening, approximately starting at the pump head top, which provides the actuating surface 5, and which protrudes into the area of the receptacle neck 3 in assigned position.

The piston rod 6 can, and as is preferred, be embodied in two pieces, in particular having a central piston rod portion 7 and an outer piston rod cylinder portion 8.

Piston rod portion 7 and piston rod cylinder portion 8 are arranged concentrically with regard to the body axis x.

The piston rod cylinder portion 8, which is designed in a tubular manner in the direction of expansion of the body axis x is mounted to the pump head 4 in the area of a receiving bushing 9, which, in the exemplary embodiment, is embodied in one piece with and preferably of the same material as the pump head top and the pump head wall. The receiving bushing 9 comprises the assigned end of the piston rod cylinder portion 8. In this area, an engagement between piston rod cylinder portion 8 and receiving bushing 9 is at hand.

While the wall inner surface of the piston rod cylinder portion 8 in a cross section at right angles to the body axis x preferably runs in a circular manner, a non-round cross section, for example an essentially rectangular cross section, results in preferred embodiment in the same section with regard to the piston rod portion 7, wherein two front faces located opposite one another in the cross section can have a wall course, which is adapted to the curvature of the inner wall of the piston rod cylinder portion 8. The cross section of the piston rod portion 7 in the permeation area of the cylinder portion can result, for example, from a circular disk shape, which is cut in a secant-like manner on both sides of a geometric center line.

Figure 3:
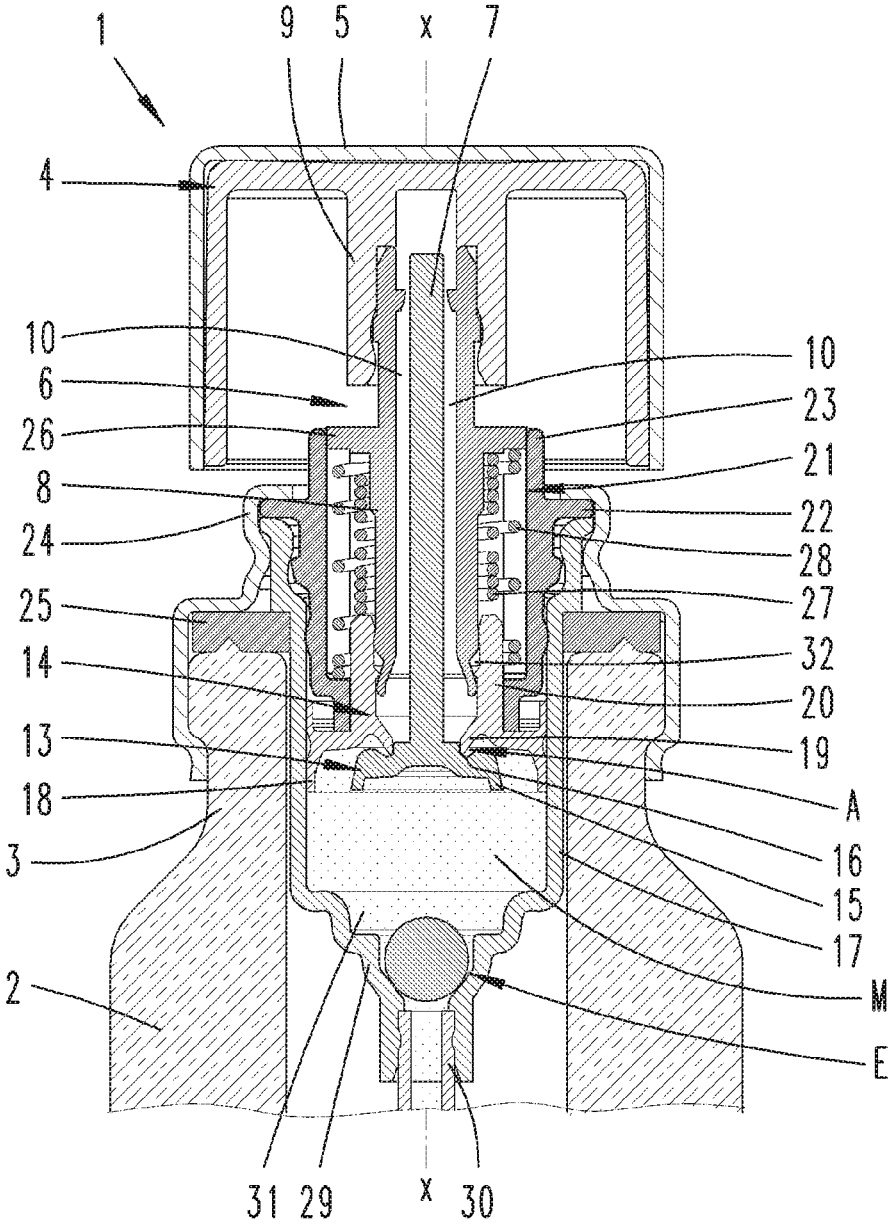
FIG. 3 shows an illustration cut by approximately 90° about the longitudinal axis of the finger spray pump as compared to FIG. 1, also relating to the non-actuated position.
Figure 4:
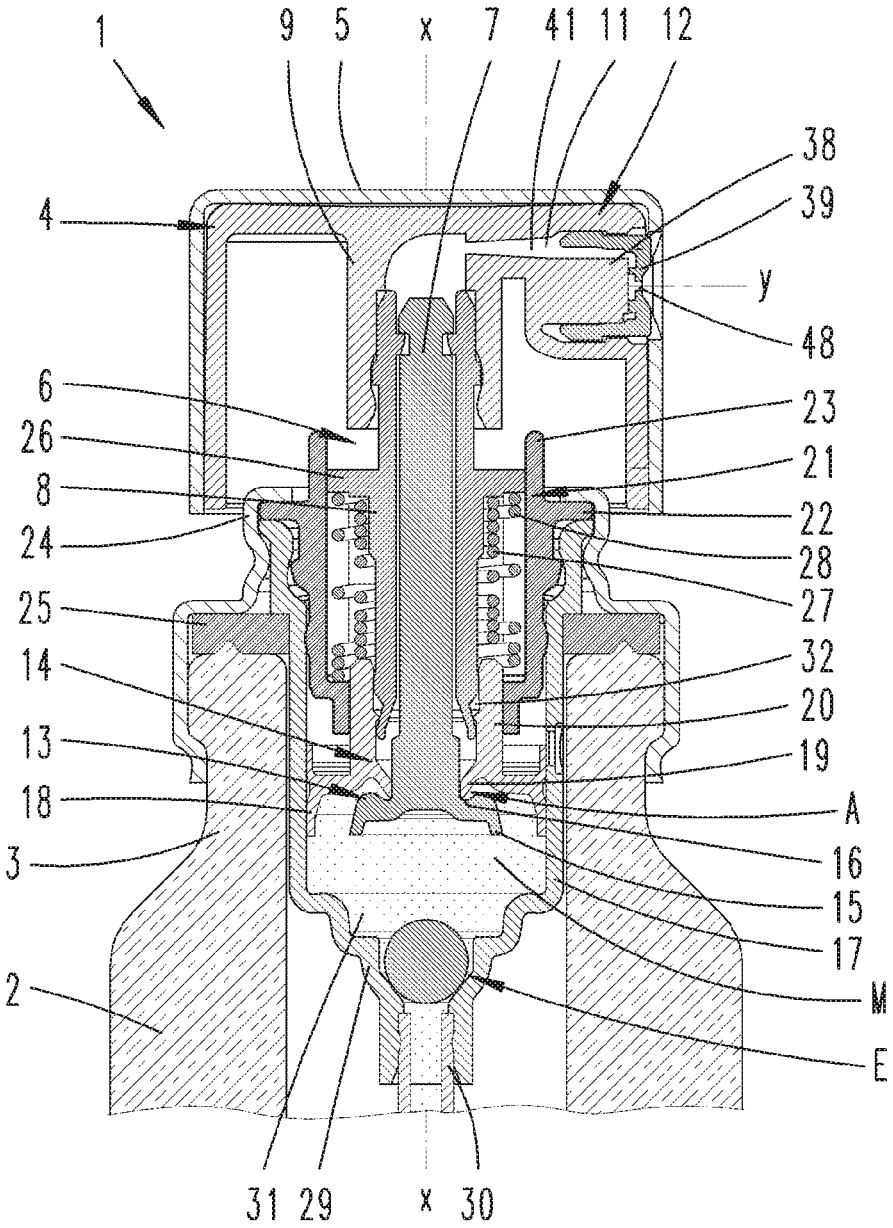
FIG. 4 shows an illustration corresponding to FIG. 1, but relating to an intermediate position as part of the actuation of the finger spray pump.

In a cross section (see FIG. 3), at least one medium path 10 thus results between the inner wall of the piston rod cylinder portion 8 and the outer wall of the piston rod portion 7, more preferably two medium paths 10 located diametrically opposite one another with regard to the body axis x.

In the coverage area of receiving bushing 9 and piston rod cylinder portion 8, the piston rod 6 is catch-mounted to the latter on the wall inner side. The piston rod portion 7 is thus secured to the piston rod cylinder portion 8 at least in the direction of extension of the body axis x.

The piston rod 6 is mounted in a tilt-proof manner in the piston rod cylinder portion 8 by means of the sections, which are adjacent to the media paths 10 in the circumferential direction and which are adapted to the inner diameter of the piston rod cylinder portion 8.

The medium paths 10 preferably extend across the entire axial length of extension of the piston rod 6, in particular within the entire coverage area of piston rod portion 7 and piston rod cylinder portion 8. The medium paths 10 lead to the underside of the actuating surface, more preferably within the receiving bushing 9, in a pump head-side radial channel 11. The latter, in turn, leads into a nozzle head 12.

The radial channel 11 is an extension of the medium path and thus part thereof.

On the end facing away from the pump head 4, the piston rod portion 7 supports a plate-like end, which widens in a radially circumferential manner in relation to the piston rod portion 7 as well as in relation to the piston rod cylinder portion 8. Said end forms a sealing extension 13 in the form of a piston bottom of a pump piston 14, which is further provided.

As a whole, the sealing extension 13 is formed in a plate-like manner, comprising a circumferential extension edge 15, which is directed downwards, i.e. facing away from the pump head 4, and which, viewed in the direction of extension of the body axis x, protrudes beyond a bottom surface of the sealing extension 13 pointing in the same direction.

Pointing in the direction of the pump head 4, a depression 16 is provided on the upper side of the sealing extension 3, surrounding an end section of the piston rod portion 7, which is radially widened in relation to the piston rod portion 7 or in relation to the inner diameter of the piston rod cylinder portion 8, respectively.

The pump piston 14 is arranged in a pump cylinder 17 so as to be movable along the body axis x.

The pump piston 14 has a bottom section, which is essentially permeated by the piston rod portion 7, furthermore essentially by the widened foot-side section of the piston rod portion 7, and which is aligned at right angles to the body axis x, and to which a piston wall 18 is integrally molded in a circumferential manner on the edge side radially on the outside, which piston wall—with regard to the direction of extension of the body axis x—extends both above and below the pump piston-side bottom section.

These piston wall sections are interrupted in the axial direction approximately at the height of the bottom section by a circumferential radial depression with regard to their radially outer circumferential surface, so that circumferential sealing areas result, which cooperate with the cylinder inner wall of the pump cylinder 17 and which are axially spaced part.

In the use state and according to the illustrations, the sealing extension 13 extends below the pump piston-side bottom section.

Facing the sealing extension 13, a sealing collar 19, which tapers conically in the direction of the sealing extension 13 and in the direction towards the body axis x, and which leaves the opening as such, is integrally molded on the bottom side of the pump piston 14, in particular on the edge side of the central opening of the pump piston 14, which is permeated by the piston rod portion 7. In an initial position according to FIG. 1, said sealing collar is located in the facing circumferential depression 16 of the sealing extension 13 so as to form a seal.

Facing away from the sealing extension 13, a guide section 20, which is preferably circular cylindrical, extends, starting at the bottom section of the pump piston 14, in one piece and preferably molded of the same material therewith. The inner diameter thereof is initially and essentially adapted to the outer diameter of the piston rod cylinder portion 8.

The pump cylinder 17 opens axially upwards in the direction of the pump head 4, wherein the corresponding end of the pump cylinder 17 radially encompasses the piston rod as a whole. In the non-actuated pump head position according to FIG. 1, an outer edge of the pump cylinder 17, which points axially upwards, preferably extends at axial distance to the opening outer edge of the pump head 4, which is directed downwards.

The free end area of the pump cylinder 17, which is directed axially upwards, is embodied radially on the inside for catch securing a guide portion 21. The guide portion 21 has a circular cross section, which is essentially adapted to the inner wall of the pump cylinder 17, and extends further radially on the inside of the pump cylinder catch section.

The guide portion 21 furthermore supports itself on the facing front outer edge of the pump cylinder 17 via a radial collar 22.

Starting at this radial collar 22, a collar 23 extends, which runs coaxially to the body axis x and which leaves a circumferential space to the piston rod 6.

The illustrated finger spray pump 1 can be embodied for the crimp connection with the receptacle 2. A cushioning connection can also be provided, furthermore a screw connection.

A crimp connection is illustrated in the figures, for the purpose of which a crimp sleeve 24 is provided, which simultaneously encompasses the guide portion 21 and the pump cylinder 17, this at least in the area of the cooperation of guide portion 21 and the catch area of the pump cylinder 17.

The crimp sleeve 24 encompasses the receptacle neck 3, wherein a support of the finger spray pump 1 on the front face of the receptacle neck 3 takes place via the crimp sleeve 24, this preferably by interconnecting a sealing disk 25.

The piston rod 6 is guided in the guide portion 21 via a shoulder 26, which is integrally molded to the piston rod cylinder portion 8, this as a result of the cooperation of the circumferential shoulder front face with the cylindrical inner surface of the guide portion 21.

In an initial position of the finger spray pump 1 according to FIG. 1, a surface of the shoulder 26, which points in the direction of the pump head 4, extends at least approximately in the opening plane of the guide portion 21, which is encompassed by the collar 23 of the guide portion 21.

Springs, in particular return springs, are preferably arranged in the circumferential space resulting between the guide portion 21 and the piston rod cylinder portion 8. As is also illustrated, these can be cylinder compression springs.

A first spring 27 (piston spring) is thus initially provided, which, encompassing the piston rod cylinder portion 8, supports itself on the underside of the shoulder 26 on the one end and acts on the guide section 20 of the pump piston 14 on the other end.

A second spring 28 (pump head spring), which engages around the first spring 27 in a diameter-enlarged manner, is provided coaxially to this first spring 27. This second spring 28 supports itself on a radial step of the guide section 20, which simultaneously provides a radially inner guide for the pump piston 14, and acts on the underside against the shoulder 26 and via the latter on the pump head 4.

The spring constant of the first spring 27, thus of the piston spring, can be selected to be greater than the spring constant of the second spring 28 (pump head spring).

The sealing extension 13, in particular the depression 16 thereof, in cooperation with the sealing collar 19 of the pump piston 14, forms an outlet valve A.

An inlet valve E is formed in the area of the pump cylinder bottom 29, preferably in the form of a ball valve, which is adjoined by a connection for a small suction tube 30 on the underside. Said small suction tube dips into the container interior.

A pump chamber 31 is created in the pump cylinder 17 between the pump cylinder bottom 29 having the inlet valve E and the pump piston 14.

The end of the piston rod cylinder portion 8 facing the pump piston 14 is provided with a taper 32 in the form of a circumferential constriction, which is directed radially inwards, and which, at the end of the cylinder portion 8, transitions into a support shoulder 33 again, which further extends radially in relation to the taper 32. Said support shoulder can have an outer diameter, which corresponds to that of the piston rod cylinder portion 8 in the area encompassed by the springs 27 and 28.

Figure 2:
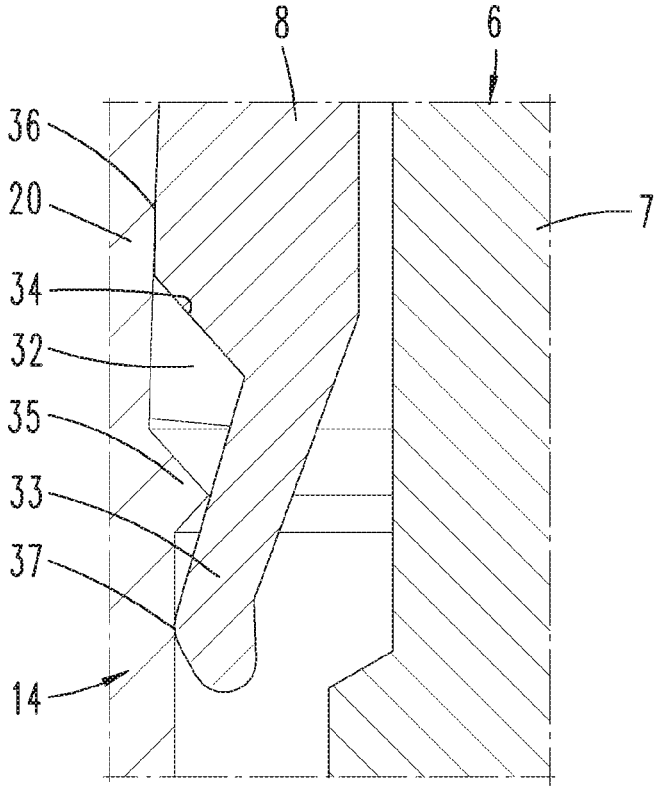
FIG. 2 shows the enlargement of the area II in FIG. 1.

With regard to a longitudinal sectional illustration through the area of the taper 32 according to the illustration in FIG. 2, a pump head-side flank 34 is created, which runs at an acute angle of 30 to 60°, for instance 45°, to a plane, viewed at right angles to the body axis x.

The taper 32 of the piston rod 6, here in particular of the piston rod cylinder portion 8, is assigned to a radially inner shoulder 35 of the pump piston 14 in the area of the guide section 20 thereof. This shoulder 35 dips into the resulting circumferential annular space in the area of the taper 32, independently of the position of the pump head 4 (initial position or spray position).

A circumferential free space, which separates two support areas 36 and 37, which are axially spaced apart, is thus created in the cooperation area of pump piston 14 and piston rod 6 or pump piston-side guide section 20 and piston rod cylinder portion 8, respectively.

The pump piston 14 as a whole is guided in a tilt-proof manner on the piston rod 6 by means of the support areas 36 and 37, which are axially spaced apart, namely by maintaining an axial displaceability of the pump piston 14 relative to the piston rod 6. As is preferred, this relative axial displaceability can be stop-limited, for example, as also illustrated, by supporting the pump piston 14 via the shoulder 35 on the respectively assigned flank in the area of the taper 32.

In the non-use position, the pump head 4 can be covered by a cover cap.

To spray the medium M, the pump head 4 is displaced downwards along the body axis x against the force of the pump head spring (second spring 28) as a result of pressurization on the actuating surface 5 thereof, this relative to the stationary guide portion 21 and the pump cylinder 17.

The first spring 27 (piston spring), which is stronger as compared to the second spring 28 (pump head spring), initially loads the pump piston 14 in the closed position of the outlet valve A, in that the piston wall 18 is pushed into the sealed position to the sealing extension 13.

Figure 5:
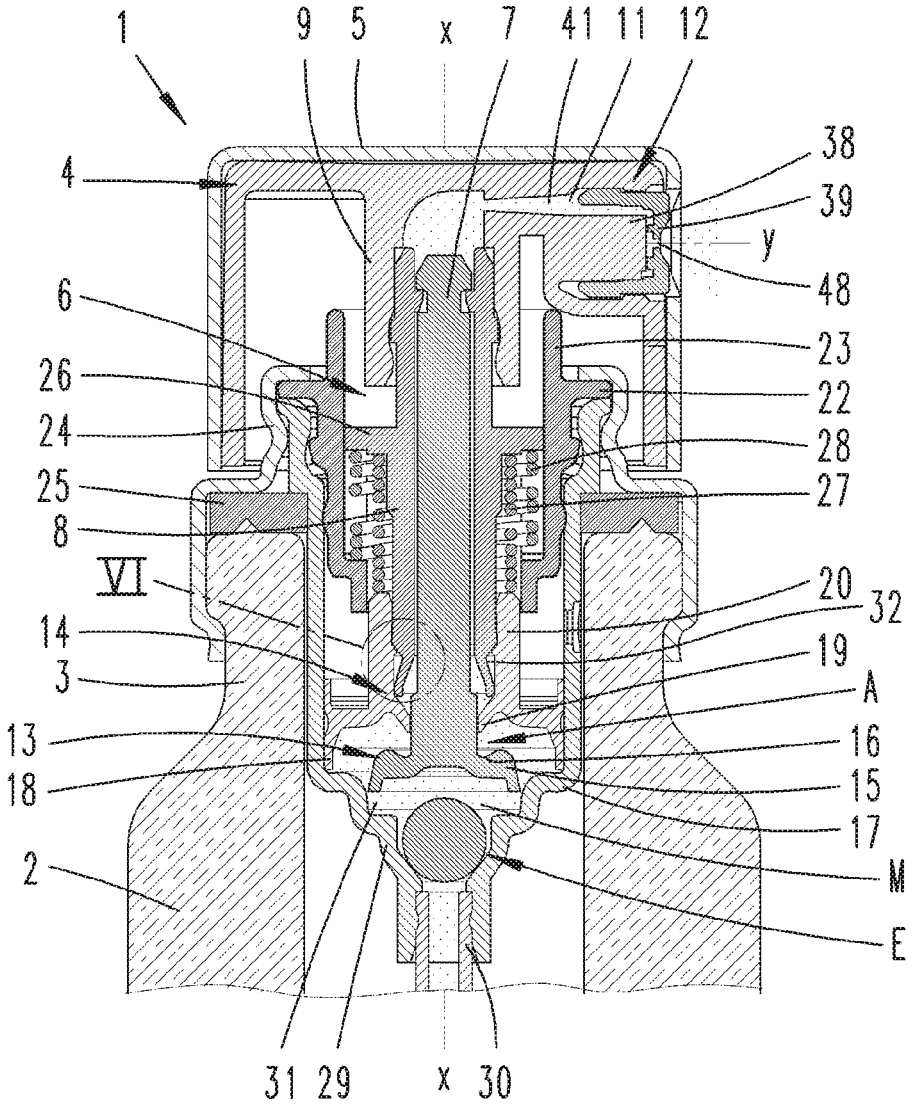
FIG. 5 shows a follow-up illustration for FIG. 4, relating to the final pump position.
Figure 6:
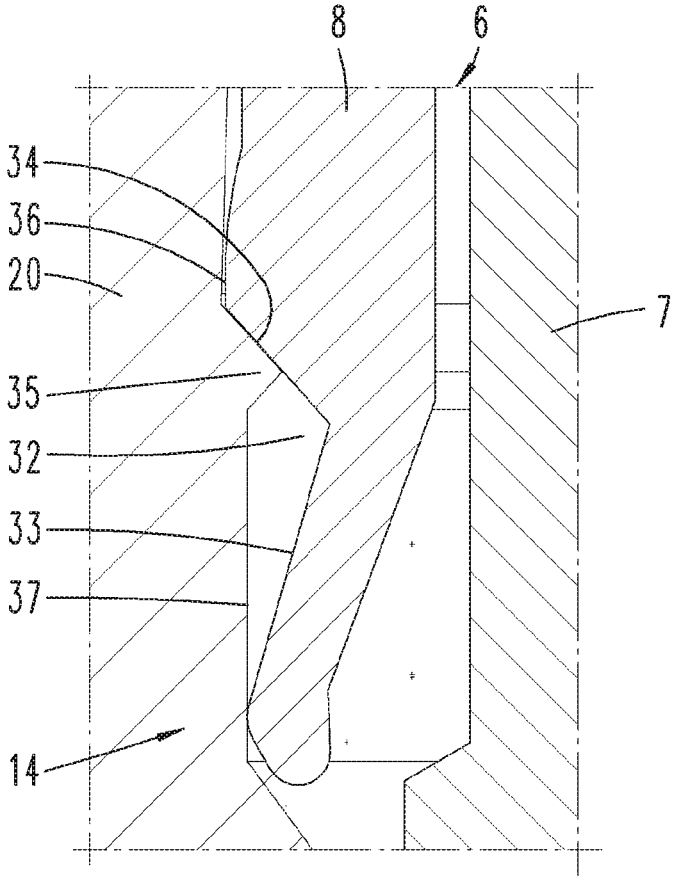
FIG. 6 shows the enlargement of the area VI in FIG. 5.
Figure 7:
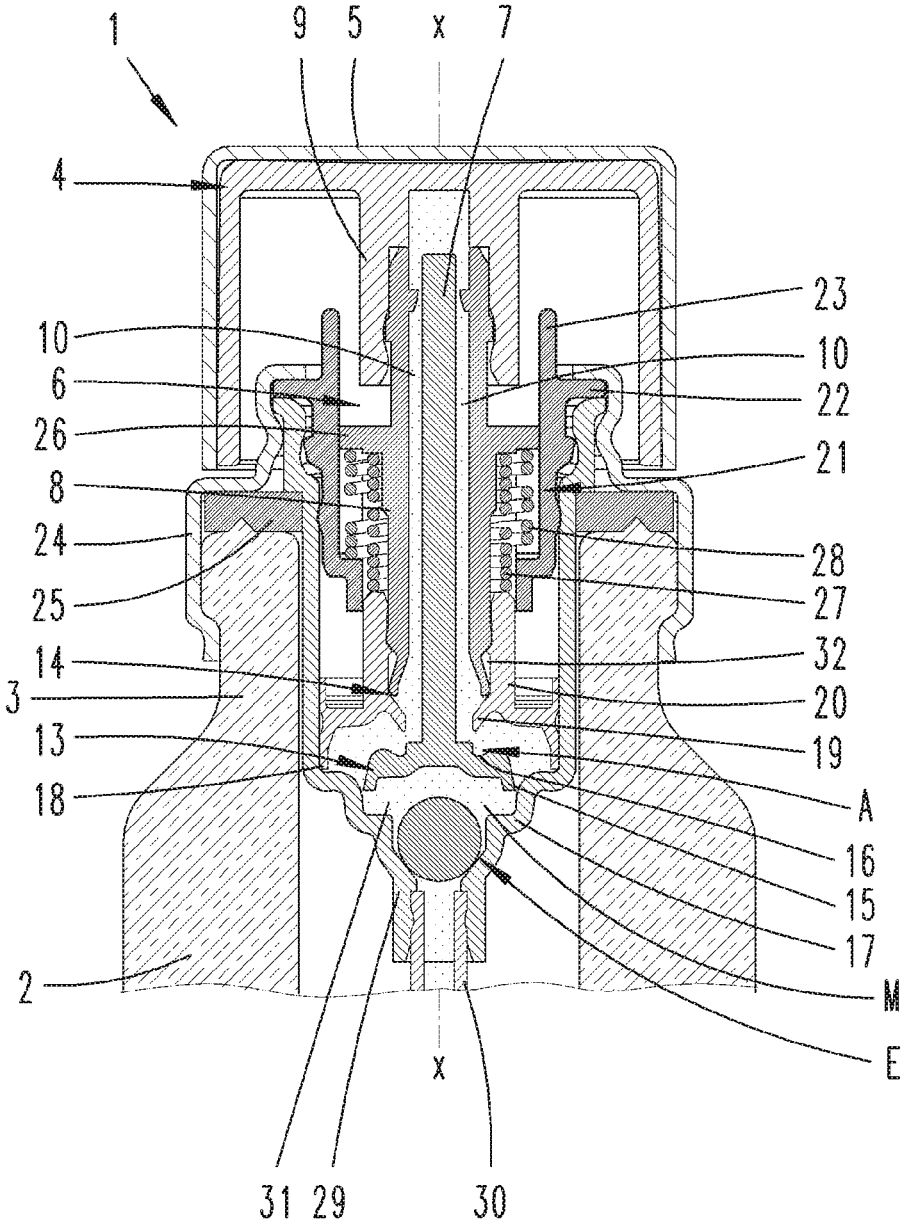
FIG. 7 shows an illustration corresponding to FIG. 2, relating to the final pump position according to FIG. 5.

The spring force of the piston spring (first spring 27) is overcome only when a pressure is reached, which exceeds the spring force of the piston spring (first spring 27), in the pump chamber 31, which is present below the pump piston 14 in the pump cylinder 17, which leads to a relative displacement of the piston rod 6 with the sealing extension 13 in relation to the pump piston 14 (see FIG. 5).

As a result of maintaining of the pressurization of the pump head 4 and the continuous depression thereof associated therewith, the medium M is discharged through the open outlet valve A and the medium path 10, which is now connected to the pump chamber 31. The medium M is sprayed out via the nozzle head 12 under pressure, until the pump piston 14, which runs along in the open state of the outlet valve A via the first spring 27 (piston spring), reaches the lowered position in a stop-limited manner.

After discharge of the medium M, the system automatically returns back to the initial position according to FIG. 1 if there is no pressurization of the pump head 4, namely as a result of corresponding return of the pump head 4 with the piston rod 6 and sealing extension 13 thereof via the pump head spring (second spring 28) and of the pump piston 14 via the piston spring (first spring 27), wherein the return advances via the stronger piston spring, in order to thus prematurely close the discharge valve A.

As part of the displacement of the pump piston 14 back into the initial position, medium M is resupplied for refilling the pump chamber 31 via the inlet valve E, which opens thereby as a result of suction effect, and the small suction tube 30.

Figure 8:
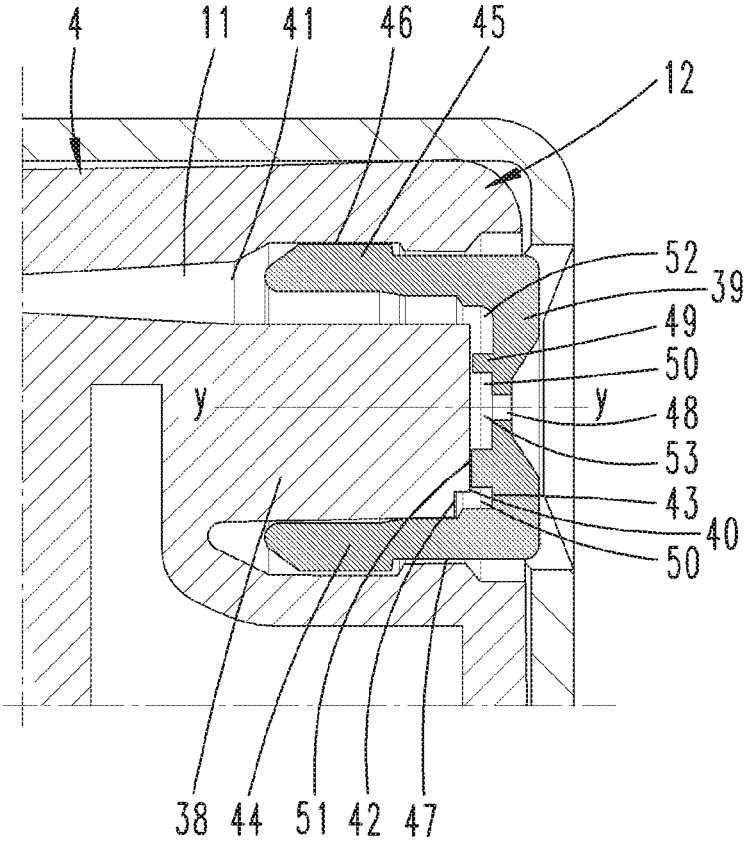
FIG. 8 shows the enlargement of the area VIII in FIG. 1.
Figure 9:
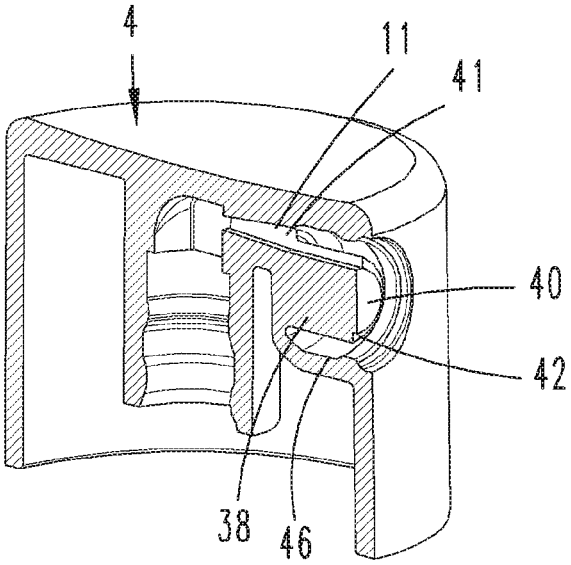
FIG. 9 shows a perspective detail illustration relating to the area of a nozzle head-side receptacle for a cap, with view onto a receiving pin.
Figure 10:
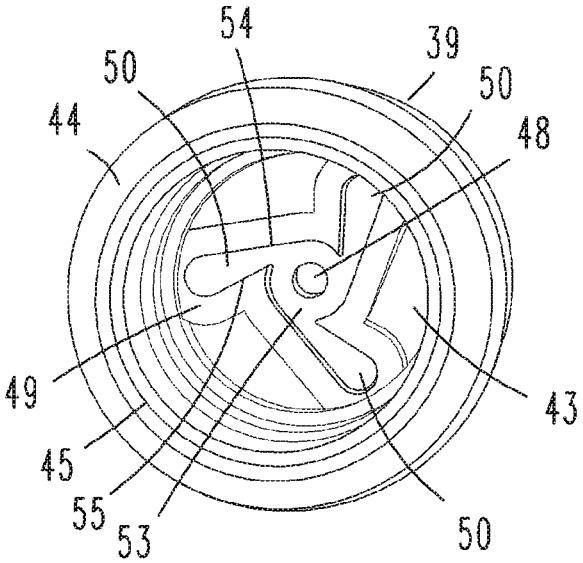
FIG. 10 shows the cap, which can be assigned to the nozzle head, with view onto a rib arrangement molded on an inner side of the cap for the formation of inlet channels in perspective illustration.

FIGS. 8 to 10 show a possible embodiment of the nozzle head 12.

The nozzle essentially consists of a receiving pin 38 assigned to the radial channel 11, and a cap 39, which can be arranged thereon.

The receiving pin 38 can, as is also illustrated, be embodied in one piece with and of the same material as the pump head 4, thereby essentially aligned along a longitudinal axis y, which is directed at right angles to the body axis x.

Directed at right angles to this axis y and pointing radially outwards freely, a flat closed front face 40 is embodied on the receiving pin 38.

The radial channel 11 is embodied as liquid path 41 in the receiving pin 38 in the direction of the longitudinal axis y thereof. With regard to a cross section, this radial channel 11 extends radially inwards in a groove-like manner at right angles to the longitudinal axis y, starting at the circumferential jacket surface of the receiving pin 38.

The front face 40 of the receiving pin 38 is surrounded by a circumferential surface 42, which runs in a staged manner in relation to said front face. Said circumferential surface can, as is also illustrated, result in a completely circumferential manner, interrupted by the liquid path 41.

The cap 39, which can be assigned, is designed in a pot-like manner, comprising a cap bottom 43 and a circumferential cap wall 44.

The cap 39 can be attached to the receiving pin 38 or can be catch-mounted to the wall of the pump head 4 surrounding the receiving pin 38 at a radial distance, respectively. For this purpose, the cap wall 44 has catch projections 45 on the outer wall side for cooperation with a catch groove 46, which is aligned coaxially to the longitudinal axis y.

In the assigned position according to FIG. 8, the inner wall side of the cap wall 44 forms the further guide path in the direction of extension of the longitudinal axis y for the medium M by means of a corresponding coverage of the radial free cut of the receiving pin 38 for forming the liquid path 41.

In the catch position according to FIG. 8, the cap 39 lies on the circumferential facing inner wall surface of the pump piston 4 so as to form a seal with a section of the cap wall 44 facing a cap bottom side. A first sealing surface 47 is thus created.

The lower surface of the cap bottom 43 facing the pin-side front face 40 preferably runs parallel and at an axial distance to the front face 40. The cap bottom 43 is centrally permeated by a spray nozzle 48.

A rib, which, according to the illustration in FIG. 10, laterally defines inlet channels 50, in the illustrated exemplary embodiment three of them, in a continuous manner according to the layout, is integrally molded on the underside of the cap bottom 43.

In the assigned position according to FIG. 8, the cap 39 supports itself via the rib 49 on the front face 40 of the receiving pin 38. A second sealing surface 51 thus results.

In a cross section at right angles to their longitudinal extension, the inlet channels 50 are laterally defined by sections of the rib 49 and are defined on the top by the cap bottom 43. Only the arrangement of the cap on the receiving pin 38 leads to the complete surrounding of an inlet channel 50 by using the pin-side front face 40 as channel bottom.

The inlet channels 50 lead radially outwards into an annular channel 52, which is created in the cap assigned position. Said annular channel results as a result of the circumferential surface 42, which is offset in a step-like manner.

To attain a favorable swirling of the medium M prior to the escape through the spray nozzle 48, the guide channels 50 run tangentially to a central chamber 53 formed between front face 40 and cap bottom 43 with regard to a layout in a plane at right angles to the longitudinal axis y.

The central chamber 53 is preferably aligned coaxially to the longitudinal axis y, accordingly having a circular cylindrically circumferential wall, into which wall the inlet channels 50 run in an open manner. With regard to a layout, a lateral boundary wall, which is formed by the rib 49, thereby preferably runs tangentially into the annular wall of the central chamber 53 (see FIG. 10).

In the layout, the inlet channels 50 are arranged so as to be distributed evenly angularly around the longitudinal axis y.

In the circumferential direction, viewed with regard to the longitudinal axis y, the continuous rib forms both the inner and the outer side wall of every inlet channel 50 and beyond that a radially outer connecting wall between inner and outer wall.

The cap 39 bears on the front face 40 so as to form a seal, preferably with the entire rib surface, which is oriented towards the receiving pin 38.

By means of the sealing surfaces 47 and 51, a systematic input of medium through the liquid path 41 and the inlet channels 50 into the central chamber 53 is at hand, from which the medium M can escape, swirled by means of the spray nozzle 48.

Figure 11:
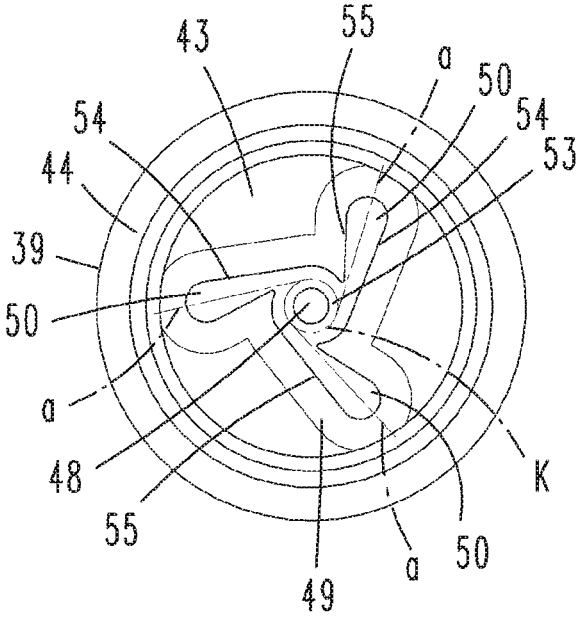
FIG. 11 shows the cap according to FIG. 10 in front view with a view onto the cap interior.

FIG. 11 shows the possible arrangement and alignment of the inlet channels 50. Every inlet channel 50 has a flow central axis a, which is oriented in the direction of the central chamber 53. In the area of the central chamber 53, these (here three) flow central axes a run tangentially into a circle K, the center of which is formed through the longitudinal axis y. The circle K thereby has a diameter, which is smaller than the diameter of the central chamber 53, which is not influenced by the inlet channels 50, and which is viewed with regard to the longitudinal axis y. The circle K can furthermore be dimensioned to be greater than the free diameter or a greatest dimension at right angles to the longitudinal axis y of the spray nozzle 48, respectively.

With regard to the layout illustration in FIG. 11, the side walls 54, which are arranged downstream from the flow central axes a in clockwise direction, run tangentially into the wall of the central chamber 53. The side walls 55, which are arranged upstream with regard to the flow central axes a in clockwise direction, can run parallel to the side walls 54. An arrangement, in the case of which a side wall 55 draws an acute angle of, for example, 10 to 30°, further for example approximately 15°, to the assigned side wall 54 of the same inlet channel 50, is illustrated.

All side walls 54 and 55 can be formed by the completely circumferential rib 49.

The above statements serve to describe the inventions captured by the application as a whole, which also further develop the prior art at least by the following feature combinations, in each case also independently, namely:

A finger spray pump, which is characterized in that the pump piston 14 is supported in the sealed position as well as in the open position on two areas 36, 37 of an outer surface of the piston rod 6, which are axially spaced apart.

A finger spray pump, which is characterized in that the support areas 36 and 37 are separated at least in the sealed position in the vertical direction by means of a horizontally circumferential free space.

A finger spray pump, which is characterized in that the first spring 27 and the second spring 28 are supported on the piston rod 6 on a radially projecting shoulder 26, and the shoulder 26 cooperates with a cylindrical inner surface of the pump housing-side guide portion 21 to guide the piston rod 6, wherein the springs 27 and 28 are furthermore radially exposed in their support areas on the piston rod 6 with regard to the guide portion 21.

A finger spray pump, which is characterized in that a radially outer front face of the shoulder 26 lies on the inner surface of the guide portion 21 in the initial position and in the spray position.

A finger spray pump, which is characterized in that the piston rod 6 consists of a central piston rod portion 7 and an outer piston rod cylinder portion 8.

A finger spray pump, which is characterized in that, on its piston-side end, the piston rod cylinder portion 8 has a taper 32, which further on the end side transitions again into a support shoulder 33, which further extends radially in relation to the taper 32.

A finger spray pump, which is characterized in that the taper 32 is assigned to a radially inner shoulder 35 of the pump piston 14, which, in the spray position, comes to lie on an edge 34 of the taper 32 on the spray head-side.

A finger spray pump, which is characterized in that the sealing extension 13 is embodied on the central piston rod portion 7.

A finger spray pump, which is characterized in that the central piston rod portion 7 is catch-mounted in the piston rod cylinder portion 8.

A finger spray pump, which is characterized in that a medium path 10 is at hand between an outer surface of the central piston rod portion 7 and an inner surface of the piston rod cylinder portion 8.

A nozzle head, which is characterized in that the boundary surfaces of the inlet channels 50, with the exception of a bottom surface, are only embodied in the cap 39.

A nozzle had, which is characterized in that the receiving pin 38 has a closed planar front face 40, which is simultaneously used to form the boundary surfaces of the inlet channels 50.

A nozzle head, which is characterized in that the front face 40 is surrounded by a circumferential surface 42, which runs in a stepped manner with regard to said front face and which extends at least across the circumferential angle, in which the inlet channels 50 are spaced apart.

A nozzle head, which is characterized in that, concerning the central chamber 53, the inlet channels 50 have flow central axes a, which run tangentially to a circle K, the center of which is formed through the longitudinal axis y.

A nozzle head, which is characterized in that a radius of the circle K is smaller than a greatest dimension of the central chamber 53 at right angles to the longitudinal axis y.

A nozzle head, which is characterized in that the side wall 54, 55 of an inlet channel 50 is embodied by a rib 49 molded in the cap 39.

A nozzle head, which is characterized in that all side walls 54, 55 are formed by a continuous rib 49.

All of the disclosed features (alone, but also in combination with one another) are essential for the invention. The disclosure content of the corresponding/enclosed priority documents (copy of the prior application) is hereby also included completely in the disclosure of the application, also for the purpose of adding features of these documents into claims of the present application. With their features, the subclaims characterize independent inventive further developments of the prior art, in particular to file divisional applications on the basis of these claims.

| LIST OF REFERENCE NUMERALS | |
|---|---|
| 1 | finger spray pump |
| 2 | receptacle |
| 3 | receptacle neck |
| 4 | pump head |
| 5 | actuating surface |
| 6 | piston rod |
| 7 | piston rod portion |
| 8 | piston rod cylinder portion |
| 9 | receiving bushing |
| 10 | medium path |
| 11 | radial channel |
| 12 | nozzle head |
| 13 | sealing extension |
| 14 | pump piston |
| 15 | extension edge |
| 16 | depression |
| 17 | pump cylinder |
| 18 | piston wall |
| 19 | sealing collar |
| 20 | guide section |
| 21 | guide portion |
| 22 | radial collar |
| 23 | collar |
| 24 | crimp sleeve |
| 25 | sealing disk |
| 26 | shoulder |

-continued

| LIST OF REFERENCE NUMERALS | |
|---|---|
| 27 | first spring |
| 28 | second spring |
| 29 | pump cylinder bottom |
| 30 | small suction tube |
| 31 | pump chamber |
| 32 | taper |
| 33 | support shoulder |
| 34 | flank |
| 35 | shoulder |
| 36 | support area |
| 37 | support area |
| 38 | receiving pin |
| 39 | cap |
| 40 | front face |
| 41 | liquid path |
| 42 | circumferential surface |
| 43 | cap bottom |
| 44 | cap wall |
| 45 | catch protrusion |
| 46 | catch groove |
| 47 | sealing surface |
| 48 | spray nozzle |
| 49 | rib |
| 50 | inlet channel |
| 51 | sealing surface |
| 52 | annular channel |
| 53 | central chamber |
| 54 | side wall |
| 55 | side wall |
| a | flow central axis |
| x | body axis |
| y | longitudinal axis |
| A | outlet valve |
| E | inlet valve |
| K | circle |
| M | medium |

The invention claimed is:

1. A finger spray pump for spraying a medium, comprising a finger-actuated pump head moveable relative to a pump housing between a spraying position and in initial position, wherein the pump housing has a guide portion, further comprising a spray nozzle and a pump chamber, wherein the pump chamber has an inlet valve and an outlet valve, a piston rod, a pump piston, a first spring acting between the piston rod and the pump piston, and a second spring acting between the piston rod and the pump housing, wherein the pump piston is further movable relative to the piston rod to a limited extent between a sealed position and an open position, to form the outlet valve, wherein the pump piston in the sealed position lies on a sealing extension of the piston rod and in the open position allows a medium to pass between the sealing extension and the pump piston, wherein further the pump piston is supported in the sealed position as well as in the open position on two support areas of an outer surface of the piston rod, which are axially spaced apart, wherein the piston rod consists of a central piston rod portion and an outer piston rod cylinder portion and wherein, on its piston-side end, the piston rod cylinder portion has a taper, which further on an end side transitions again into a support shoulder, which further extends radially in relation to the taper, wherein the taper is assigned to a radially inner support shoulder of the pump piston, which, in the spray position, comes to lie on an edge of the taper on a spray head-side.

2. The finger spray pump according to claim 1, wherein the support areas are separated at least in the sealed position in the vertical direction by means of a horizontally circumferential free space.

3. The finger spray pump according to claim 1, wherein the first spring and the second spring are supported on the piston rod on a radially projecting shoulder, and the shoulder of the piston rod cooperates with a cylindrical inner surface of the pump housing-side guide portion to guide the piston rod, wherein the springs are furthermore radially exposed in their support areas on the piston rod with regard to the guide portion.

4. The finger spray pump according to claim 3, wherein a radially outer front face of the shoulder of the piston rod lies on the inner surface of the guide portion in the initial position and in the spray position.

5. The finger spray pump according to claim 1, wherein the sealing extension is embodied on the central piston rod portion.

6. The finger spray pump according to claim 1, wherein the central piston rod portion is catch-mounted in the piston rod cylinder portion.

7. The finger spray pump according to claim 6, wherein a medium path is disposed between an outer surface of the central piston rod portion and an inner surface of the piston rod cylinder portion.

8. A nozzle head for a spray pump, comprising a pump head, a receiving pin in the pump head, and a cap having a spray nozzle being catch-mounted in the pump head in association with the receiving pin, wherein the receiving pin has a longitudinal axis extending in the mounting direction of the cap, and a liquid path in the direction of the longitudinal axis is embodied in the receiving pin, which liquid path leads to a central chamber positioned upstream of the spray nozzle, wherein the central chamber further has inlet channels, which extend in a plane running perpendicular to the longitudinal axis and which are partly formed by an inner surface of the cap and partly by an outer surface of the receiving pin, wherein further boundary surfaces of the inlet channels, with the exception of a bottom surface, are only embodied in the cap and wherein the receiving pin has a closed planar front face, which is simultaneously used to form the boundary surfaces of the inlet channels, wherein the front face is surrounded by a circumferential surface, which runs in a stepped manner with regard to said front face and which extends at least across the circumferential angle, in which the inlet channels are spaced apart, wherein the inlet channels radially outwards lead into an annular channel, which is created as a result of the circumferential surface, wherein side walls of all of the inlet channels are formed by a continuous rib formed in the cap and wherein the running through rib in circumferential direction and seen with reference to a longitudinal axis builds the inner side wall as well as the outer side wall of each inlet channel and moreover a radial outer connection wall between the outer side wall and the inner side wall of each inlet channel.

9. The nozzle head according to claim 8, wherein, concerning the central chamber, the inlet channels have flow central axes, which run tangentially to a circle, a center of which is formed through the longitudinal axis.

10. The nozzle head according to claim 9, wherein a radius of the circle is smaller than a greatest dimension of the central chamber at right angles to the longitudinal axis.

* * * * *